US008174198B2

(12) United States Patent
Tsuda et al.

(10) Patent No.: US 8,174,198 B2
(45) Date of Patent: May 8, 2012

(54) IMAGE DISPLAY APPARATUS AND METHOD FOR DRIVING THE SAME

(75) Inventors: Hisanori Tsuda, Atsugi (JP); Yasue Sato, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 497 days.

(21) Appl. No.: 12/400,162

(22) Filed: Mar. 9, 2009

(65) Prior Publication Data

US 2009/0243497 A1 Oct. 1, 2009

(30) Foreign Application Priority Data

Mar. 31, 2008 (JP) ..... 2008-091556

(51) Int. Cl.
*H05B 37/00* (2006.01)

(52) U.S. Cl. ..... 315/160; 315/167; 315/169.4

(58) Field of Classification Search ..... 315/160, 315/167, 169.4, 172, 84.61, 84.57, 360, 209 R, 315/224, 291, 297, 306, 307, 308, 310, 334, 315/362

See application file for complete search history.

(56) References Cited

U.S. PATENT DOCUMENTS

| | | | | |
|---|---|---|---|---|
| 5,223,766 | A | 6/1993 | Nakayama et al. | |
| 6,107,745 | A | 8/2000 | Mougin et al. | |
| 6,459,209 | B1 | 10/2002 | Elloway et al. | |
| 7,279,846 | B2 | 10/2007 | Gofuku et al. | 315/111.91 |
| 7,301,269 | B2 | 11/2007 | Gofuku et al. | 313/495 |
| 7,439,661 | B2 | 10/2008 | Sato et al. | 313/156 |
| 7,446,467 | B2 | 11/2008 | Tsuda et al. | 313/495 |
| 7,511,425 | B2 | 3/2009 | Tsuda et al. | 313/549 |
| 2004/0145544 | A1 | 7/2004 | Suzuki et al. | |
| 2006/0043871 | A1 | 3/2006 | Kamio et al. | 313/495 |
| 2006/0087220 | A1 | 4/2006 | Hiroki et al. | |
| 2008/0203947 | A1 | 8/2008 | Negishi et al. | |

FOREIGN PATENT DOCUMENTS

| | | | |
|---|---|---|---|
| EP | 0 455 162 | A2 | 11/1991 |
| EP | 0 455 162 | A3 | 11/1991 |
| EP | 0 455 162 | B1 | 1/1996 |
| JP | 4-12436 | A | 1/1992 |
| JP | 5-121012 | A | 5/1993 |
| JP | 2006-127781 | A | 5/2006 |
| WO | 02/097774 | A2 | 12/2002 |
| WO | 2006/006423 | A1 | 1/2006 |

OTHER PUBLICATIONS

Partial European Search Report issued in the counterpart application No. 09153278.8 dated Jul. 5, 2010.

*Primary Examiner* — Douglas W Owens
*Assistant Examiner* — Jianzi Chen
(74) *Attorney, Agent, or Firm* — Fitzpatrick, Cella, Harper & Scinto

(57) ABSTRACT

An image display apparatus includes a rear plate including electron-emitting devices, a face plate including an anode electrode, a voltage applying unit configured to apply a voltage to the anode electrode, a switching unit configured to switch between a display state of displaying an image and a non-display state of displaying no image, and a timing unit. The timing unit measures a non-display time, which is an amount of time that the switching unit allows the non-display state to continue. After the timing unit has measured a certain non-display time, the voltage applying unit applies, to the anode electrode, a second voltage lower than a first voltage to be applied in the display state, to enable the electron-emitting devices to emit electrons.

4 Claims, 5 Drawing Sheets

IMAGE DISPLAY APPARATUS AND METHOD FOR DRIVING THE SAME

BACKGROUND

1. Field

Example embodiments described herein relate to a flat image display apparatus and a method for driving the apparatus. Particularly, example embodiments described herein relate to an image display apparatus including electron-emitting devices and a method for driving the apparatus.

2. Description of the Related Art

It is known to provide a flat image display apparatus to display an image by applying an electron beam emitted from an electron source provided on a flat substrate to a phosphor on an opposite substrate to cause the phosphor to emit light. In such an image display apparatus, the inside of a vacuum container accommodating the electron source and the phosphor should be kept in a high-vacuum state. This is because, if gas is generated and pressure rises in the vacuum container, the electron source can be detrimentally affected, and the amount of emitted electrons can be reduced, although these conditions can vary depending on the type of gas employed.

In order to mitigate such conditions, Japanese Patent Laid-Open No. 4-12436 suggests a configuration having a gate electrode made of a getter material to absorb generated gas.

A getter can be classified into an evaporative type getter and a non-evaporative type getter. Some types of gases are easily absorbed by a getter and other types of gases are not easily absorbed by a getter. The exhaust velocity of the evaporative type getter is very high with respect to water and oxygen, but is very low with respect to an inert gas, such as argon (Ar). Also, the exhaust velocity of the non-evaporative type getter is very low with respect to an inert gas, such as argon.

Typically, when an orbit of electrons emitted from an electron-emitting device is straight toward an opposite electrode, an inert gas such as Ar existing in space is ionized by collision due to the emitted electrons. Inert gas ions generated through the ionization have positive monovalent or multivalent charge, and are accelerated in a direction opposite to that of electrons accelerated by an electric field, and collide with a substrate provided with an electron source (just under an inert gas ion generating unit with high energy). That is, after electrons emitted from an electron-emitting device have passed over the electron-emitting device, accelerated inert gas ions generated through ionization collide with an electron-emitting device existing immediately below, and damage the electron-emitting device. In some cases, discharge may be caused inside and the apparatus may become broken.

In view of such circumstances, Japanese Patent Laid-Open No. 5-121012 suggests a configuration in which an ion pump is externally attached to a main body of a vacuum container of a flat image display apparatus.

U.S. Pat. No. 6,107,745 suggests a configuration including inert-gas-ionizing electron-emitting devices having a sacrificial area provided outside of an image display area of a panel. Electrons are emitted from the electron-emitting devices during a period when no image is displayed.

Japanese Patent Laid-Open No. 2006-127781 suggests a configuration for deflecting electrons emitted from electron-emitting devices from just above the electron-emitting devices, and capturing an inert gas.

Furthermore, U.S. Pat. No. 6,459,209 suggests a configuration of ionizing and exhausting an inert gas with the use of electron-emitting devices in an image display area by raising an anode voltage to 50% of the voltage for displaying an image and maintaining the raised voltage.

SUMMARY

However, in the configuration according to Japanese Patent Laid-Open No. 4-12436, an active gas is exhausted by a getter material but an inert gas such as Ar and He is hardly exhausted. In particular, the exhaust velocity of a chemically-stable gas such as a methane gas is significantly low, so that such a gas is difficult to be exhausted.

Among inert gases, Ar accounts for about 1% of the air and is drawn into a constituent material of an image display apparatus during a process of manufacturing the image display apparatus. When the constituent material of the image display apparatus includes a sputter film containing Ar, a large amount of Ar is contained in the material.

Ar has a relatively high weight, and thus electron-emitting devices can become severely damaged if acceleration is caused by a high electric field after ionization, which can result in a shorter life span for the electron-emitting devices.

In the configuration having an externally-attached ion pump according to Japanese Patent Laid-Open No. 5-121012, it is possible that a local rise in pressure of an inert gas in a flat image display apparatus having poor conductance may not be adequately handled. Also, a magnetic field used by the ion pump causes deflection of a beam. Accordingly, some measures such as magnetic shielding can be used, but result in a complicated manufacturing process and high cost.

Likewise, in a configuration according to U.S. Pat. No. 6,107,745, it is possible that a local rise in pressure in a flat image display apparatus having poor conductance may not be adequately handled. Furthermore, since inert-gas-ionizing electron-emitting devices are placed only outside of an image area, and the inert-gas-ionizing electron-emitting devices have a configuration that can be degraded, it is possible that sufficient exhaust velocity and quantity are not obtained.

In the configuration according to Japanese Patent Laid-Open No. 2006-127781, an inert gas capturing unit to capture an inert gas has a complicated electrode structure, which causes an increased cost.

In the configuration according to U.S. Pat. No. 6,459,209, an undesirably long time is taken to display a bright image after power-on.

An inert gas such as Ar often is not exhausted by a getter, and is thus gradually emitted to the space inside an image display apparatus after the image display apparatus has been produced. Therefore, partial pressure of the inert gas can rise while no electron is emitted from electron-emitting devices. Particularly, in the case where no image has been displayed in the image display apparatus for a long time, the partial pressure of the inert gas can be significantly high.

Existing measures against such a rise in partial pressure of a gas not sufficiently exhausted by a getter are not necessarily sufficient.

At least some example embodiments described herein below can extend the life of electron-emitting devices.

According to an example embodiment, there is provided an image display apparatus including a rear plate including electron-emitting devices; a face plate including an anode electrode; a voltage applying unit configured to apply a voltage to the anode electrode; a switching unit configured to switch between a display state of displaying an image and a non-display state of displaying no image; and a timing unit. The timing unit measures a non-display time, which is an amount of time that the switching unit allows the non-display state to continue. After the timing unit has measured a certain non-display time, the voltage applying unit applies, to the anode electrode, a second voltage lower than a first voltage to be applied in the display state, to enable the electron-emitting devices to emit electrons.

According to another example embodiment, there is provided an image display apparatus including a rear plate including electron-emitting devices; a face plate including an anode electrode; a voltage applying unit configured to apply a voltage to the anode electrode; a switching unit configured to switch between a display state of displaying an image and a non-display state of displaying no image; and a timing unit. If the non-display state is set by the switching unit after the timing unit has measured a certain time, the voltage applying unit applies, to the anode electrode, a second voltage lower than a first voltage to be applied in the display state, to enable the electron-emitting devices to emit electrons.

According to another example embodiment, there is provided an image display apparatus including a rear plate including electron-emitting devices; a face plate including an anode electrode; a voltage applying unit configured to apply a voltage to the anode electrode; and a vacuum gauge configured to measure a partial pressure of gas inside the image display apparatus. If the partial pressure of the gas exceeds a reference partial pressure, the voltage applying unit applies, to the anode electrode, a second voltage lower than a first voltage to be applied to display an image in the image display apparatus, to permit the electron-emitting devices to emit electrons.

According to another example embodiment, there is provided a method for driving an image display apparatus including a rear plate including electron-emitting devices, a face plate including an anode electrode, a voltage applying unit configured to apply a voltage to the anode electrode, and a switching unit configured to switch between a display state of displaying an image and a non-display state of displaying no image. After a non-display time exceeds a reference first time, the voltage applying unit applies, to the anode electrode, a second voltage lower than a first voltage to be applied in the display state, to enable the electron-emitting devices to emit electrons. The non-display time is a time when the switching unit allows the non-display state to continue.

According to another example embodiment, there is provided a method for driving an image display apparatus including a rear plate including electron-emitting devices, a face plate including an anode electrode, a voltage applying unit configured to apply a voltage to the anode electrode, and a switching unit configured to switch between a display state of displaying an image and a non-display state of displaying no image. After a reference time has elapsed, determining whether the display state or non-display state is set by the switching unit and, if the non-display state is set by the switching unit after the reference time has elapsed, applying, from the voltage applying unit to the anode electrode, a second voltage lower than a first voltage to be applied in the display state, to enable the electron-emitting devices to emit electrons.

According to another example embodiment, there is provided a method for driving an image display apparatus including a rear plate including electron-emitting devices, a face plate including an anode electrode, and a voltage applying unit configured to apply a voltage to the anode electrode. If a partial pressure of gas inside the image display apparatus exceeds a reference partial pressure, applying from the voltage applying unit to the anode electrode, a second voltage lower than a first voltage to be applied to the anode electrode, to display an image and enable the electron-emitting devices to emit electrons.

At least some of the foregoing embodiments can extend the life of the electron-emitting devices.

Further features of the present invention will become apparent from the following description of exemplary embodiments with reference to the attached drawings.

DESCRIPTION OF THE EMBODIMENTS

Hereinafter, example embodiments will now be described with reference to the accompanying drawings.

<First Embodiment>

(Configuration of Image Display Apparatus)

Figure 1A:
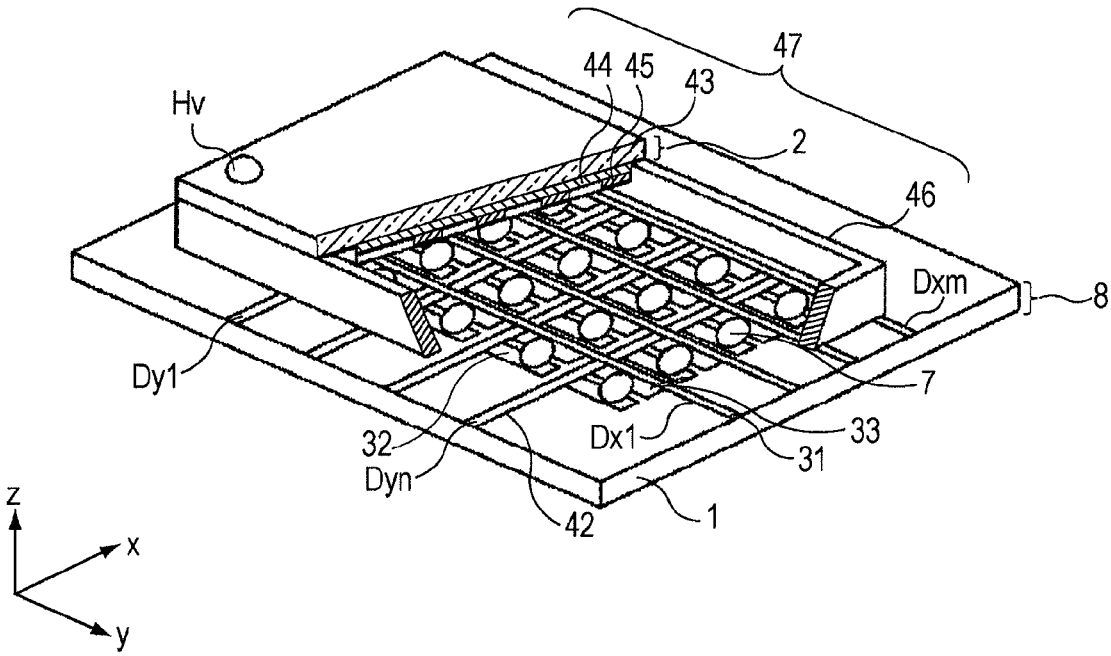
FIGS. 1A and 1B illustrate an example of a configuration of an image display apparatus according to one example embodiment.

FIG. 1A is a perspective view illustrating an example of a configuration of an image display apparatus according to an embodiment herein, which is partially cutaway.

As illustrated in FIG. 1A, a vacuum container 47 includes a rear plate 8 and a face plate 2 sandwiching a support frame 46 in this embodiment.

The rear plate 8 includes at least an electron source substrate 1, electron-emitting devices 7 placed on the electron source substrate 1, electrical connection terminals Dx1 to Dxm and Dy1 to Dyn, a column wiring 31, a row wiring 42, and device electrodes 32 and 33. The electrical connection terminals Dx1 to Dxm and Dy1 to Dyn are terminals to feed power to the electron-emitting devices 7 from the outside of the vacuum container 47 and electrically connect to corresponding column wirings 31 and row wirings 42, respectively. The device electrodes (high-voltage side) 33 and the device electrodes (low-voltage side) 32 electrically connect to corresponding column wirings 31 and row wirings 42, respectively, and also electrically connect to corresponding electron-emitting devices 7. The device electrodes 32 and 33 enable a voltage to be applied to the electron-emitting devices 7 from outside of the vacuum container 47. In one example embodiment, surface-conduction electron-emitting devices are used as the electron-emitting devices 7, although in other embodiments other types of electron-emitting devices can be used.

The face plate 2 includes at least a transparent substrate 43 made of glass or the like, a fluorescent film 44 placed on the transparent substrate 43, and a metal back 45 (also referred to as an "anode electrode"). The metal back 45 functions as an electrode and an emitted-light reflecting thin film through which electron beams emitted from the electron-emitting devices 7 pass. The fluorescent film 44 is irradiated with the electron beams passed through the metal back 45 to which high voltage is applied, thereby emitting light to display an image.

A high-voltage terminal Hv (also referred to as a "voltage applying unit") is an electrical connection terminal having an airtight structure to feed power to the metal back 45 from the outside of the vacuum container 47.

Although not illustrated in FIG. 1A for convenience, the rear plate 8 is provided with a getter.

Figure 1B:
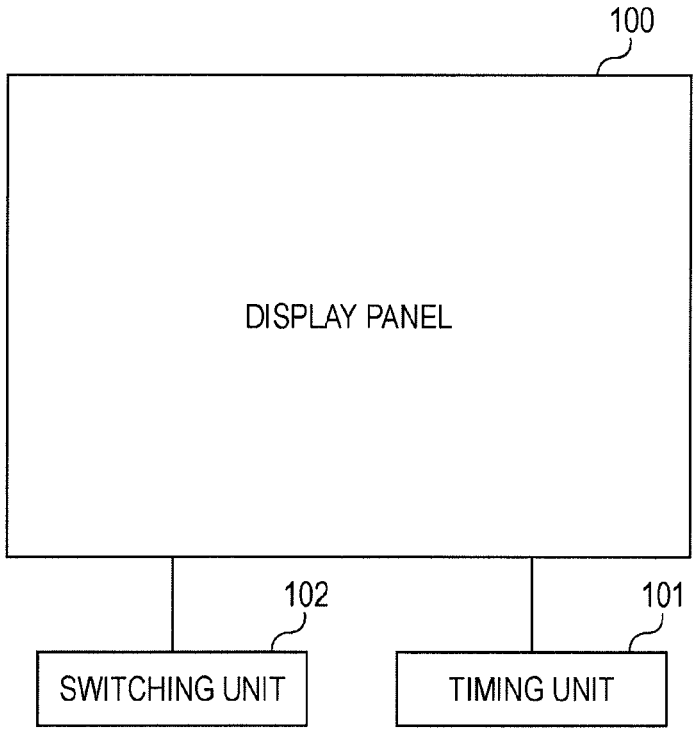

As illustrated in FIG. 1B, in the image display apparatus according to this embodiment, a display panel 100 having a configuration such that illustrated in FIG. 1A connects to a timing unit 101 and a switching unit 102 to switch between a display state of displaying an image in the image display apparatus and a non-display state of displaying no image.

In this embodiment, a timer is provided as the timing unit 101. The position where the timer is provided is not particularly germane. For example, the timer may be provided in a driving circuit to drive the electron-emitting devices 7, or at another selected location.

Examples of the switching unit 102 include a switch that is directly provided in the image display apparatus, a remote control to switch between the display state and the non-display state, etc.

(Method for Driving Image Display Apparatus)

Figure 2:
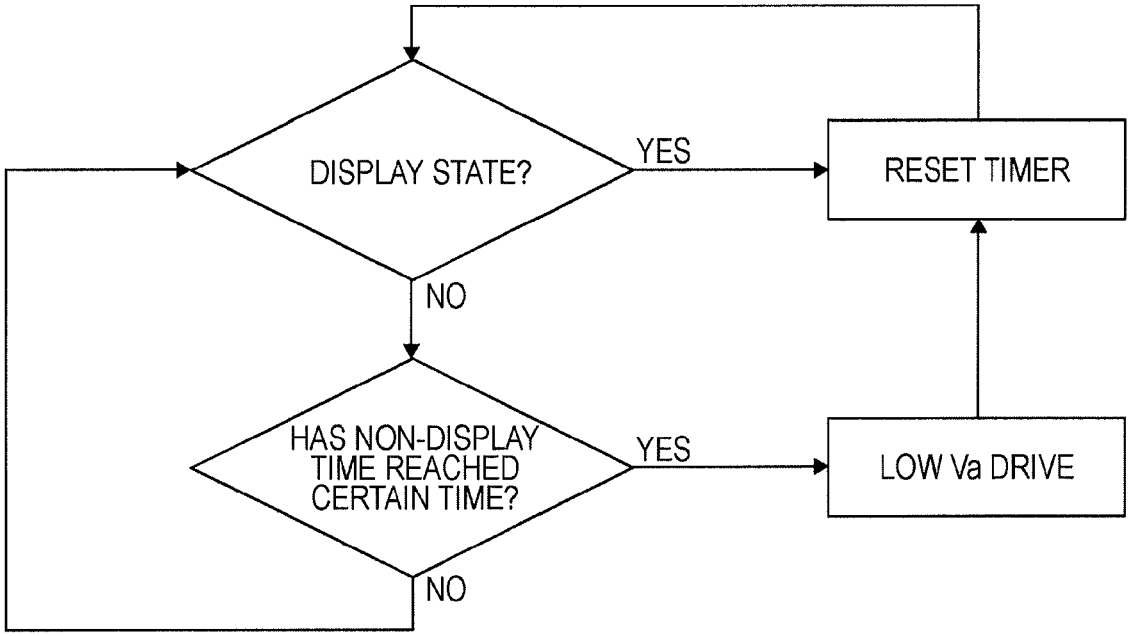
FIG. 2 illustrates a driving method according to a first example embodiment.

FIG. 2 is an example of a sequence diagram illustrating a driving method according to this embodiment.

In this embodiment, the timing unit 101 measures the time when the switching unit 102 continues the non-display state (non-display time). The timer is reset when the switching unit 102 switches the state from the non-display state to the display state. In one example, the display state is a state where an image is displayed in the image display apparatus with electrons being emitted from the electron-emitting devices, and does not include the state where no image is displayed in the image display apparatus with electrons being emitted from the electron-emitting devices. However, in other embodiments the display state can have other meanings, such as a combination of the foregoing states or otherwise.

As described above, an inert gas such as Ar is ionized by an electron beam and becomes positive ions, which come into collision with the rear plate 8. Thus, the partial pressure of the inert gas drops in the display state. On the other hand, in the non-display state, the partial pressure of the inert gas rises. Therefore, the partial pressure of the inert gas inside the image display apparatus becomes higher as the non-display time is longer to some extent.

In this embodiment, a voltage (also referred to as a "second voltage") lower than a voltage (also referred to as a "first voltage") applied to the anode electrode when an image is displayed in the image display apparatus (in the display state) is applied to the anode electrode after the non-display time has reached a reference time (or certain amount of time) ("certain time" in FIG. 2). Furthermore, the electron-emitting devices 7 are enabled to emit electrons in the state where the second voltage is applied to the anode electrode. The driving, or applying of the second voltage to the anode electrode to cause the electron-emitting devices 7 to emit electrons, is referred to herein as "low Va drive", for convenience. In this example embodiment, the first voltage is 10 kV, although other suitable values can be used.

The low Va drive can be performed in the non-display state, and thus light emission through electron emission caused by the low Va drive can be performed such the display is not visually recognizable by humans. When the low Va drive is performed, the brightness can be 1 $Cd/m^2$ or lower, although other brightness values can be used.

The "certain time" represented in FIG. 2 can be appropriately set in accordance with the characteristics and specifications of the image display apparatus. For example, an allowable or desired non-display time can be set in view of at least one of an increase rate of the partial pressure of an inert gas per unit time, the partial pressure of an inert gas allowing the electron-emitting devices to resist collision of an ionized inert gas, the partial pressure of an inert gas inside the image display apparatus after the image display apparatus is driven, and so on. Those times can be set by, for example, measuring a time change in internal partial pressure of an inert gas by using a sample image display apparatus having the same configuration.

The low Va drive is stopped after it has been performed for a predetermined time period. At this time, the timer is reset.

The timer is reset also when the state is switched to the display state because an inert gas is ionized and exhausted also when an image is displayed in the image display apparatus. The reset timer starts to measure the time again when the switching unit sets the non-display state.

In this embodiment, the timing unit 101 and the switching unit 102 do not directly connect to each other in FIG. 1B. However, the timing unit 101 and the switching unit 102 may directly connect to each other and the timing unit 101 may measure time and perform reset in response to a signal from the switching unit 102. Also, even in the case where the timing unit 101 and the switching unit 102 do not directly connect to each other as illustrated in FIG. 1B, a signal from the switching unit 102 may be transmitted to the timing unit 101 via the display panel 100.

This embodiment enables the partial pressure of an inert gas inside the image display apparatus to not exceed a reference partial pressure.

Figure 3A:
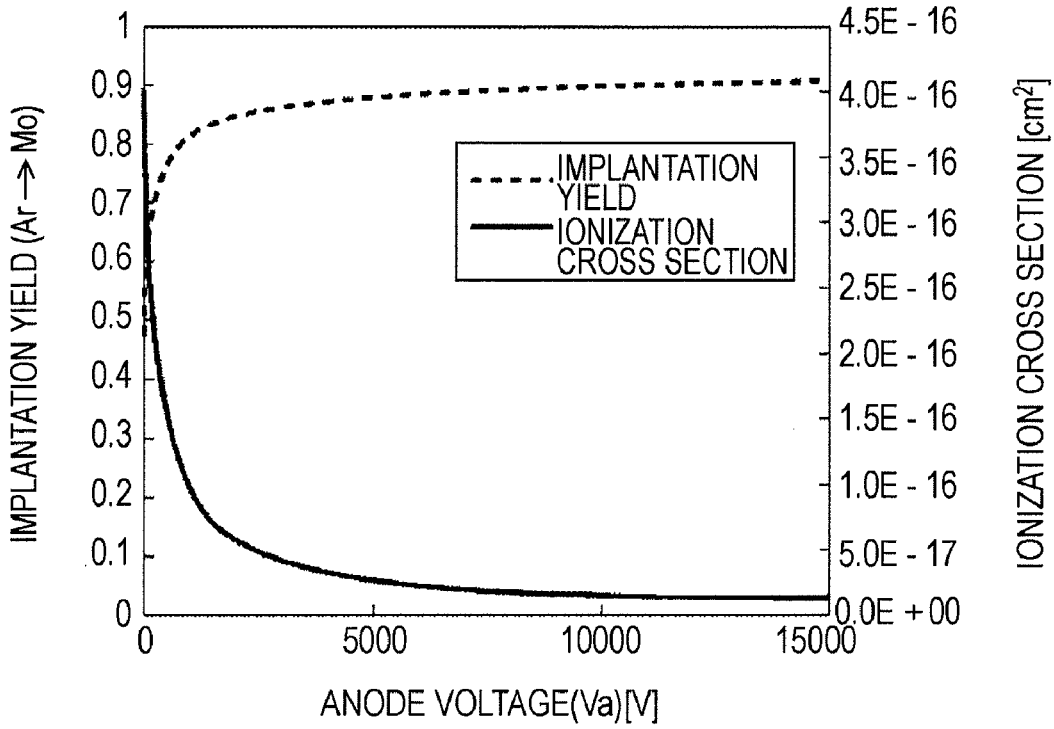
FIGS. 3A and 3B illustrate energy dependence of ionization cross section and yield of Ar ions.
Figure 3B:
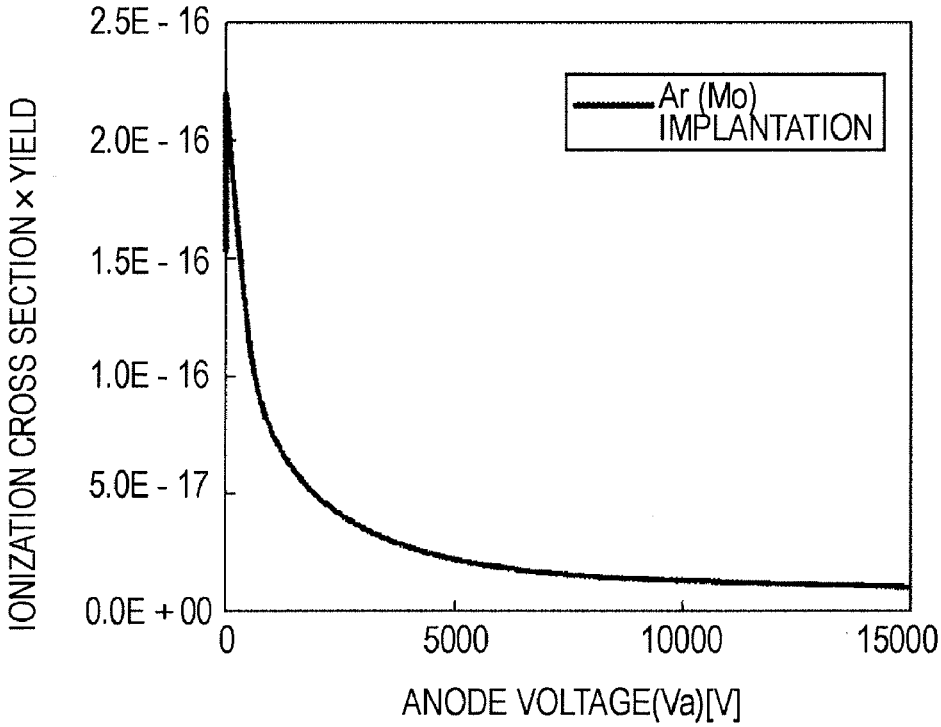

FIGS. 3A and 3B illustrate energy dependence of an ionization cross section and a yield of Ar ions, serving as an indicator of Ar ion capture.

In FIG. 3A, the horizontal axis indicates anode voltages applied to the metal back 45. The right vertical axis indicates ionization cross sections of Ar. The left vertical axis indicates yields of Ar ions to the rear plate 8.

In FIG. 3B, the horizontal axis indicates anode voltages applied to the metal back 45. The vertical axis indicates the products of the ionization cross sections and the yields illustrated in FIG. 3A.

As illustrated in FIG. 3A, when the energy of electrons coming into collision with Ar is high, the ionization cross section is small and thus the generation rate of Ar ions decreases. On the other hand, the yield of Ar ions is low when the energy of Ar ions is too low. In other words, when the anode voltage to accelerate Ar ions is too low, the probability that ionized Ar molecules coming into collision with the rear plate 8 are captured into the rear plate 8 is low. Therefore, the probability that Ar ions reach and are captured into the rear plate 8 is calculated by multiplying the ionization cross section by the yield of Ar ions, as illustrated in FIG. 3B.

As can be understood from FIG. 3B, the second voltage should range from 0.1 to 4 kV in order to efficiently ionize an inert gas and capture the ionized inert gas in the rear plate 8.

By performing the low Va drive, energy of collision can be reduced even if Ar ions come into collision with the electron-emitting devices 7, so that the electron-emitting devices 7 are less likely to be damaged.

The curve indicating yields of Ar ions illustrated in FIG. 3A is a result obtained when Ar ions come into collision with molybdenum (Mo) existing in the rear plate substrate. Also, a curve having a similar shape is obtained when Ar ions come into collision with another type of metal.

As described above, performing the low Va drive enables an inert gas to be efficiently ionized and captured in the rear plate 8.

Also, in this embodiment where surface-conduction electron-emitting devices are used as the electron-emitting devices 7, electrons emitted from the electron-emitting devices 7 are deflected from the device electrodes (low-voltage side) 32 toward the device electrodes (high-voltage side) 33 (in the x direction illustrated in FIG. 1). At the same time, the electrons emitted from the electron-emitting devices 7 reach the face plate 2 while spreading in the x and y directions. The spread of the emitted electrons depends on an anode voltage. The spread range of the emitted electrons in the x and y directions is narrower as the anode voltage is higher, whereas the spread range of the emitted electrons in the x and y directions is wider as the anode voltage is lower. The spread range of the electrons should be wide so that an inert gas can be efficiently ionized.

When surface-conduction electron-emitting devices are used, emitted electrons spread in the x and y directions while moving in translation in the x direction. Therefore, an ionized inert gas hardly comes into collision with the electron-emitting devices that emitted the electrons. However, if the anode voltage drops and if a translation amount of emitted electrons in the x direction increases, an ionized inert gas can come into collision with other electron-emitting devices. Thus, in the case of using electron-emitting devices emitting electrons that perform translation, such as surface-conduction electron-emitting devices, the value of the anode voltage should be set so as to reduce collision of an ionized inert gas with other electron-emitting devices.

Figure 4:
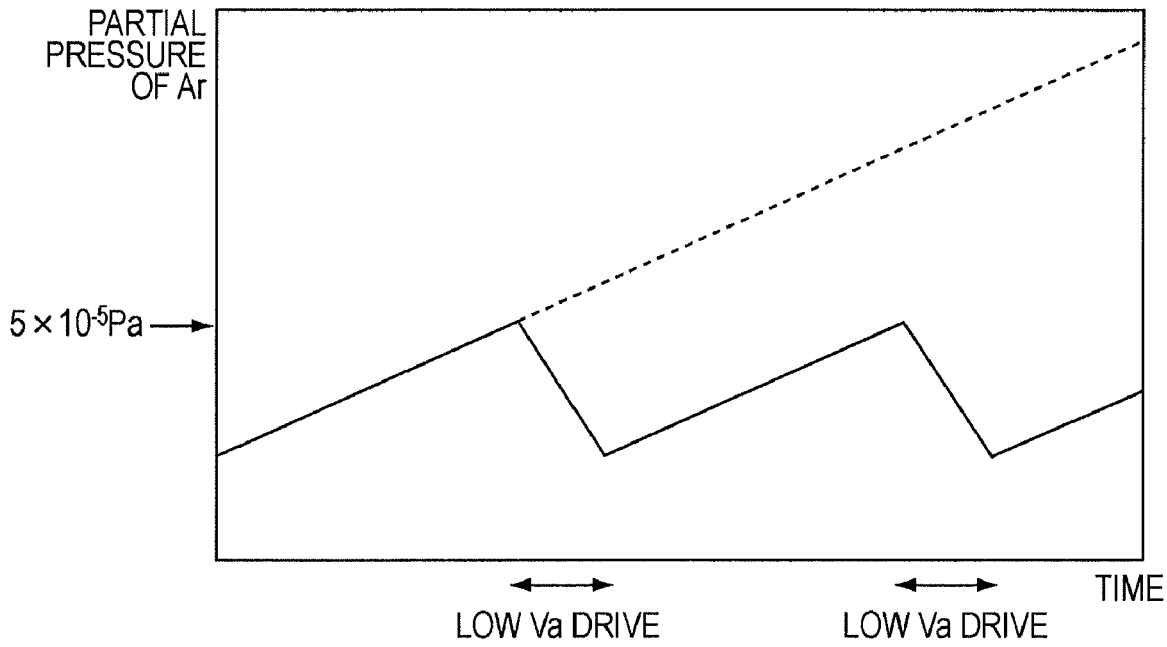
FIG. 4 illustrates a time change in partial pressure of an Ar gas when the driving method according to the first embodiment is performed.

Referring to FIG. 4, a solid line indicates time changes in partial pressure of an Ar gas in the case where the driving method according to this embodiment is performed with the display state not being set by the switching unit. The horizontal axis indicates time and the vertical axis indicates the partial pressure of Ar. A broken line in the figure indicates changes in partial pressure of an Ar gas in the non-display state in the case where the driving method according to this embodiment is not performed.

As illustrated in FIG. 4, the partial pressure of the Ar gas rises with time in the non-display state. If the partial pressure of the Ar gas exceeds $5\times10^{-4}$ Pa, damage on the electron-emitting devices 7 significantly increases.

In this embodiment, as indicated by the solid line in FIG. 4, the partial pressure of an inert gas such as Ar is decreased by performing the low Va drive so that the partial pressure of Ar does not exceed $5\times10^{-5}$ Pa. Specifically, a rise in partial pressure of the inert gas can be suppressed by performing the low Va drive when the non-display time exceeds a reference time.

In this embodiment, the low Va drive is performed by setting a reference non-display time on the basis of conditions to prevent the partial pressure of Ar from exceeding $5\times10^{-5}$ Pa. However, the reference non-display time varies depending on the configuration of the image display apparatus, and thus can be appropriately set in accordance with the configuration of the image display apparatus.

The time period to perform the low Va drive can be appropriately set in accordance with characteristics of the image display apparatus, for example, the partial pressure of an inert gas at the time when the low Va drive starts, the anode voltage at the time when the low Va drive is performed, the amount of decrease in partial pressure of an inert gas at the time when the low Va drive is performed per unit time, and so on.

In this example embodiment, the time period to perform the low Va drive is set to 5 minutes. Furthermore, the low Va drive should be performed for 20 minutes or more.

If the display state is set by the switching unit during the low Va drive, the low Va drive is stopped and an anode voltage necessary to display an image in the image display apparatus (corresponding to "first voltage" of the present invention) is applied to the anode electrode.

In this case, since the low Va drive has not been completed, the amount of decrease in partial pressure of an inert gas caused by the low Va drive is insufficient. However, the partial pressure of the inert gas decreases in the display state and thus the partial pressure of the inert gas can be prevented from exceeding a predetermined partial pressure.

<Second Embodiment>

In the above-described embodiment, surface-conduction electron-emitting devices are used as the electron-emitting devices 7. This embodiment is different from the first embodiment in that Spindt-type electron-emitting devices are used as the electron-emitting devices 7.

When the Spindt-type electron-emitting devices are used, electrons emitted from the electron-emitting devices travel straight up from the electron-emitting devices (in the z direction in FIG. 1), unlike in the first embodiment where the surface-conduction electron-emitting devices are used. The electrons emitted from the electron-emitting devices reach the face plate 2 while spreading in the x and y directions. An inert gas ionized immediately above the electron-emitting devices can come into collision with the electron-emitting devices that emitted the electrons.

However, spread of emitted electrons depends on the anode voltage even when the Spindt-type electron-emitting devices are used. Emitted electrons spread in a narrower range in the x and y directions as the anode voltage is higher, and emitted electrons spread in a wider range in the x and y directions as the anode voltage is lower. It is better that the spread range of electrons is wider in order to efficiently ionize an inert gas.

The energy of an inert gas coming into collision with the rear plate 8 is reduced by performing the low Va drive. As a result, even if inert gas ions come into collision with the electron-emitting devices, the electron-emitting devices are less likely to be damaged.

In this way, by selecting an appropriate value of the anode voltage for the low Va drive, the present invention can be applied to an image display apparatus including electron-emitting devices emitting electrons that travel straight up, such as Spindt-type electron-emitting devices.

In addition, the present invention can be applied to an image display apparatus including normally-on-type electron-emitting devices that emit electrons only by applying a voltage to the anode electrode.

<Third Embodiment>

In the above-described first embodiment, the timer to measure the non-display time is reset when the switching unit sets the display state. This embodiment is different in considering the time when an image is continuously displayed in the image display apparatus (display time).

Figure 5:
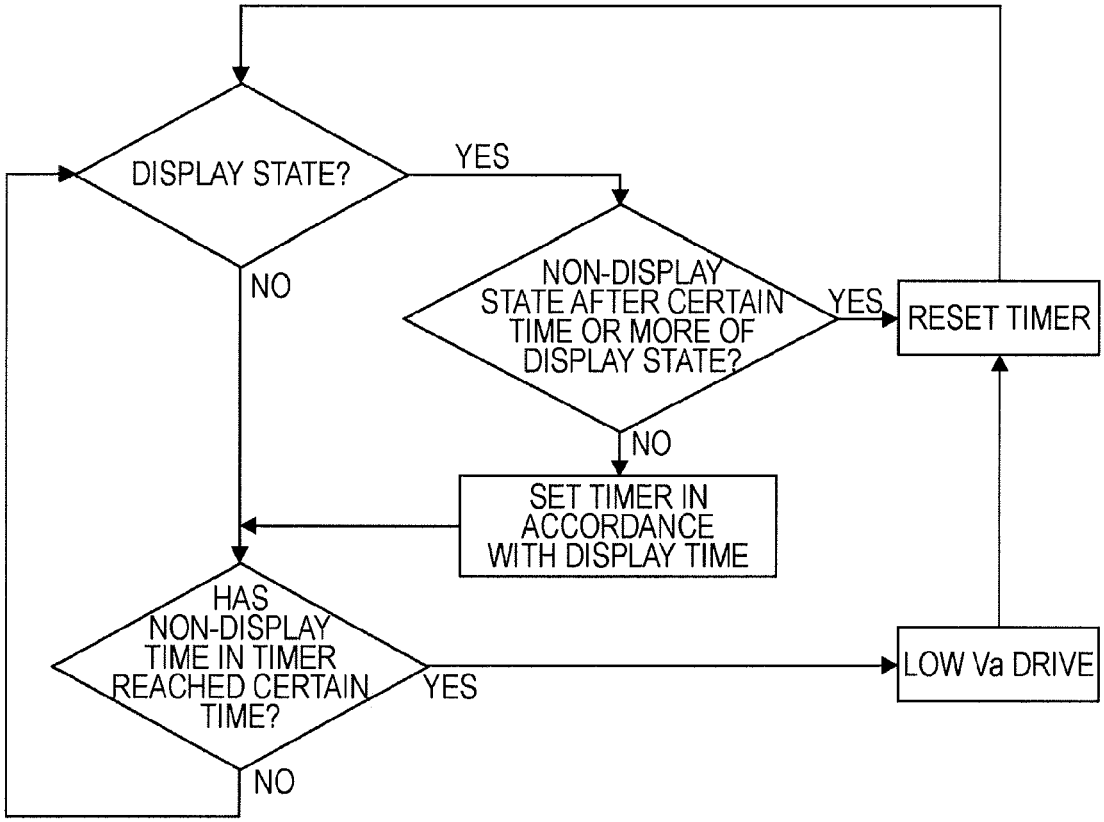
FIG. 5 illustrates a driving method according to a third example embodiment.

FIG. 5 is a sequence diagram illustrating a driving method according to this embodiment.

The partial pressure of an inert gas drops when the image display apparatus is set to the display state. However, if the display time is short, it is possible that the partial pressure of the inert gas does not sufficiently drop. If the timer is reset in such a case, it is possible that the partial pressure of Ar gas exceeds a predetermined partial pressure ($5\times10^{-5}$ Pa in the first embodiment) when the non-display time reaches the reference time.

In this embodiment, as in the first embodiment, the low Va drive is performed and the timer is reset when the non-display time reaches the reference time (corresponding to "first time").

Furthermore, in this embodiment, the timer is reset when the display time reaches the certain time (corresponding to "second time"). If the state is switched to the non-display state before the display time reaches the certain time, the value of the timer is set in accordance with the display time. As a result, if the state is switched to the non-display state before the display time reaches the second time, the low Va drive is performed before the non-display time reaches the above-described first time.

The manner of setting the timer according to the display time can be appropriately determined in accordance with the characteristics of the image display apparatus. Specifically, the manner can be determined in accordance with the value of the timer when the state is switched from the non-display state to the display state, the amount of decrease in partial pressure of an inert gas when the image display apparatus is driven by unit time, and so on.

According to this embodiment, the life of the electron-emitting devices can be extended more reliably.

<Fourth Embodiment>

In the above-described first and third embodiments, the low Va drive is performed by measuring the non-display time. In this embodiment, the low Va drive is performed when a measured time (any of the display time and non-display time) exceeds a reference time. That is, the low Va drive is performed at certain time intervals.

Note that, if the apparatus is in the display state when the low Va drive is to be performed after the reference time has elapsed, priority is put on the display state and the low Va drive is not performed. As a configuration to determine whether the display state is set by the switching unit after the reference time has elapsed, a configuration to disable the low Va drive when a signal of the display state is transmitted from the switching unit 102 to the display panel 100 in FIG. 1B can be used.

In this embodiment, the low Va drive may be performed even when the partial pressure of an inert gas such as Ar is sufficiently lower than the reference partial pressure (e.g., $5\times10^{-5}$ Pa). However, in this embodiment, too, the low Va drive is performed before the partial pressure of an inert gas exceeds the reference partial pressure, and thus the life of the electron-emitting devices can be extended.

The timer according to this embodiment does not need to determine whether the switching unit is set to the display state or the non-display state and thus has a simple configuration.

<Fifth Embodiment>

In the above-described embodiments, the partial pressure of an inert gas is prevented from exceeding the reference partial pressure by using the timer to measure the non-display time. On the other hand, in this embodiment, a vacuum gauge to measure the partial pressure of an inert gas is attached to the image display apparatus.

As the vacuum gauge, a vacuum gauge utilizing ionization of gas, such as an ion gauge, may be used. Alternatively, a vacuum gauge utilizing heat conduction, such as a thermistor vacuum gauge, may be used.

In the configuration according to this embodiment, unlike in the configuration of estimating the partial pressure of an inert gas by measuring the non-display time, the partial pressure of an inert gas is actually measured by using a partial pressure vacuum gauge, so that the life of the electron-emitting devices can be extended more reliably.

Figure 6:
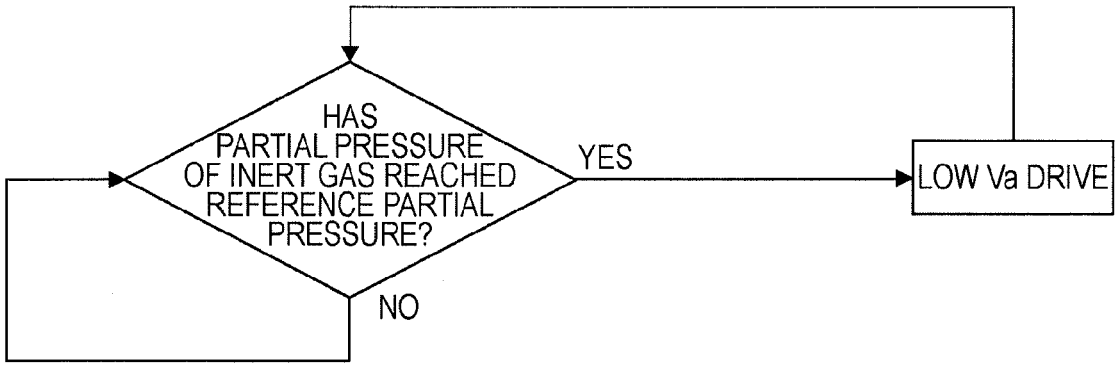
FIG. 6 illustrates a driving method according to a fifth example embodiment.

FIG. 6 illustrates a driving method according to this embodiment.

In the driving method illustrated in FIG. 2, the timer is reset by determining whether the image display apparatus is in the display state. In the driving method illustrated in FIG. 5, the timer is set or the value of the timer is set in view of the display time. According to this embodiment, the partial pressure of an inert gas can be actually measured and thus the life of the electron source can be extended without monitoring whether the image display apparatus is in the display state or in the non-display state.

<Sixth Embodiment>

In the above-described embodiments, the low Va drive is performed when time or partial pressure reaches the reference time or reference partial pressure respectively by using the timer or the vacuum gauge. In this embodiment, the low Va drive is performed first when power is supplied to the image display apparatus.

The partial pressure of an inert gas can become high after an image display apparatus has been manufactured until the image display apparatus is distributed to a user. In such a case, if the user supplies power to the image display apparatus for the first time after the image display apparatus has been shipped as a product, and if the user performs image display immediately after supplying power, the electron-emitting devices can be damaged in the case of at least some known apparatuses.

Even if the image display apparatus has a function of performing the low Va drive according to the above-described embodiments, if the user stops supplying power to the image display apparatus for some reason, the function is not used because no power is supplied. As a result, the partial pressure of an inert gas can rise while power supply to the image display apparatus is stopped.

In this embodiment, the low Va drive is performed when power is supplied to the image display apparatus. Thus, damage to the electron-emitting devices caused by the partial pressure of an inert gas that rises while no power is supplied to the image display apparatus, can be suppressed or substantially minimized.

EXAMPLE 1

In this example, the image display apparatus illustrated in FIG. 1A provided with a partial pressure vacuum gauge was used. Surface-conduction electron-emitting devices were used as the electron-emitting devices 7.

Every time the partial pressure of an Ar gas measured by the partial pressure vacuum gauge exceeded $5\times10^{-5}$ Pa, the low Va drive was performed for 10 minutes by applying pulses of 60 Hz having a pulse width of 5 μsec at 0 V to the device electrodes (low-voltage side) 32 via the row wiring 42 and at 18 V to the device electrodes (high-voltage side) 33 via the column wiring 31 and by applying 1 kV to the high-voltage terminal Hv. After six months of non-display state in the image display apparatus, an image was displayed by applying pulses of 60 Hz having a pulse width of 12 μsec at 0 V to the device electrodes (low-voltage side) 32 via the row wiring 42 and at 18 V to the device electrodes (high-voltage side) 33 via the column wiring 31 and by applying 10 kV to the high-voltage terminal Hv. Then, little decrease was observed in current emitted from the electron-emitting devices 7 compared to the initial state (six months prior). This is because the electron-emitting devices 7 were not damaged by an ionized inert gas such as Ar.

COMPARATIVE EXAMPLE 1

In this comparative example, the low Va drive in example 1 was not performed. After six months of non-display state in the image display apparatus, the partial pressure of an Ar gas measured by the partial pressure vacuum gauge increased to $5\times10^{-4}$ Pa.

In this image display apparatus, an image was displayed by applying pulses of 60 Hz having a pulse width of 12 μsec at 0 V to the device electrodes (low-voltage side) 32 via the row wiring 42 and at 18 V to the device electrodes (high-voltage side) 33 via the column wiring 31 and by applying 10 kV to the high-voltage terminal Hv. Then, a 12% decrease was observed in current emitted from the electron-emitting devices 7 compared to the initial state (six months prior). This is because the electron-emitting devices 7 were damaged by an ionized inert gas such as Ar.

EXAMPLE 2

In this example, the image display apparatus including the display panel 100 provided with the timer (timing unit 101) to measure the non-display time illustrated in FIG. 1B was used. In this example, the low Va drive was performed in the sequence illustrated in FIG. 2.

In this example, a trigger was output after the timer counted 200 hours and the low Va drive was performed for 10 minutes. Also, performing the low Va drive caused the timer to be reset.

After six months of non-display state, an image was displayed by applying pulses of 60 Hz having a pulse width of 12 μsec at 0 V to the device electrodes (low-voltage side) 32 via the row wiring 42 and at 18 V to the device electrodes (high-voltage side) 33 via the column wiring 31 and by applying 10 kV to the high-voltage terminal Hv.

Then, little decrease was observed in current emitted from the electron-emitting devices 7 compared to the initial state (six months prior). This is because the electron-emitting devices 7 were not damaged by an ionized inert gas such as Ar.

EXAMPLE 3

In this example, the image display apparatus including the display panel 100 provided with the timer (timing unit 101) to measure the non-display time illustrated in FIG. 1B was used. In this example, the low Va drive was performed in the sequence illustrated in FIG. 2.

In this example, a trigger was output after the timer counted 200 hours and the low Va drive was performed for 10 minutes. Also, performing the low Va drive caused the timer to be reset.

Also, the timer was reset when the display state was set by the switching unit.

After six months of substantial non-display state, but where at least once per month a display state was set by the switching unit, an image was displayed by applying pulses of 60 Hz having a pulse width of 12 μsec at 0 V to the device electrodes (low-voltage side) 32 via the row wiring 42 and at 18 V to the device electrodes (high-voltage side) 33 via the column wiring 31 and by applying 10 kV to the high-voltage terminal Hv.

Then, little decrease was observed in current emitted from the electron-emitting devices 7 compared to the initial state (six months prior). This is because the electron-emitting devices 7 were not damaged by an ionized inert gas such as Ar.

EXAMPLE 4

In this example, the image display apparatus including the display panel 100 provided with the timer (timing unit 101) to measure the display time and the non-display time illustrated in FIG. 1B was used.

In this example, if the apparatus was in the non-display state at the time when the timer counted 200 hours, a trigger was output and the low Va drive was performed for 10 minutes. Performing the low Va drive caused the timer to be reset.

On the other hand, if the apparatus was in the display state at the time when the timer counted 200 hours, priority was put on the display state and the low Va drive was not performed. However, in the case where the display time was shorter than 10 minutes as the time period to perform the low Va drive (e.g., 3 minutes) and the apparatus was brought into the non-display state, the timer was reset after the low Va drive (e.g., 7 minutes). That is, any of the display state and the low Va drive occurred for 10 minutes after the timer to measure the non-display time counted 200 hours.

After six months of non-display state, but where at least once per month a display state was implemented for several minutes or several tens of minutes in the image display apparatus, an image was displayed by applying pulses of 60 Hz having a pulse width of 12 μsec at 0 V to the device electrodes (low-voltage side) 32 via the row wiring 42 and at 18 V to the device electrodes (high-voltage side) 33 via the column wiring 31 and by applying 10 kV to the high-voltage terminal Hv.

Then, little decrease was observed in current emitted from the electron-emitting devices 7 compared to the initial state (six months prior). This is because the electron-emitting devices 7 were not damaged by an ionized inert gas such as Ar.

FIFTH EXAMPLE

In this example, the image display apparatus illustrated in FIG. 1A provided with a partial pressure vacuum gauge was used. Surface-conduction electron-emitting devices were used as the electron-emitting devices 7.

In this example, the image display apparatus had been left for six months with no power being supplied thereto. Then, the partial pressure of an Ar gas measured by the partial pressure vacuum gauge increased to $5\times10^{-4}$ Pa. Then, power was supplied to the image display apparatus. Ten minutes of low Va drive was performed at the power supply. Then, an image was displayed by applying pulses of 60 Hz having a pulse width of 12 μsec at 0 V to the device electrodes (low-voltage side) 32 via the row wiring 42 and at 18 V to the device electrodes (high-voltage side) 33 via the column wiring 31 and by applying 10 kV to the high-voltage terminal Hv. Then, little decrease was observed in current emitted from the electron-emitting devices 7 compared to the initial state (six months prior). This is because the low Va drive performed at the power supply decreased the partial pressure of an inert gas and the electron-emitting devices 7 were not damaged by an ionized inert gas such as Ar.

COMPARATIVE EXAMPLE 2

In this example, the image display apparatus illustrated in FIG. 1A provided with a partial pressure vacuum gauge was used. Surface-conduction electron-emitting devices were used as the electron-emitting devices 7.

In this example, the image display apparatus had been left for six months with no power being supplied thereto. Then, the partial pressure of an Ar gas measured by the partial pressure vacuum gauge increased to $5\times10^{-4}$ Pa. Then, power was supplied to the image display apparatus. In this comparative example, an image was displayed by applying pulses of 60 Hz having a pulse width of 12 μsec at 0 V to the device electrodes (low-voltage side) 32 via the row wiring 42 and at 18 V to the device electrodes (high-voltage side) 33 via the column wiring 31 and by applying 10 kV to the high-voltage terminal Hv without performing the low Va drive. Then, a 12% decrease was observed in current emitted from the electron-emitting devices 7 compared to the initial state (six months prior). This is because the electron-emitting devices 7 were damaged by an ionized inert gas such as Ar.

While exemplary embodiments have been described, it is to be understood that the claims are not limited only to the disclosed exemplary embodiments described herein. The scope of the following claims is to be accorded the broadest interpretation so as to encompass all modifications and equivalent structures and functions.

This application claims the priority benefit of Japanese Application No. 2008-091556 filed Mar. 31, 2008, which is hereby incorporated by reference herein in its entirety, as if set forth fully herein.

What is claimed is:

1. A method for driving an image display apparatus including a rear plate including electron-emitting devices, a face plate including an anode electrode, a voltage applying unit configured to apply a voltage to the anode electrode, and a switching unit configured to switch between a display state of displaying an image and a non-display state of displaying no image, the method comprising:

after a non-display time exceeds a referenced first time, and if the switching unit sets the non-display state before a display time exceeds a reference second time, after the non-display time exceeds a time shorter than the first time in accordance with the display time, the voltage applying unit applies, to the anode electrode, a second voltage lower than a first voltage to be applied in the display state, to enable the electron-emitting devices to emit electrons, wherein the non-display time is a time when the switching unit allows the non-display state to continue, and the display time is a time when the switching unit allows the display state to continue.

2. The method according to claim 1, wherein, when power is supplied to the image display apparatus, the voltage applying unit applies the second voltage to the anode electrode.

3. The method according to claim 1, wherein the second voltage ranges from 0.1 kV to 4 kV.

4. The method according to claim 1, wherein the second voltage causes image brightness to be 1 $Cd/m^2$ or lower when the second voltage is applied to the anode electrode and when the electron-emitting devices emit electrons.

* * * * *